US005415574A

United States Patent [19]

Siviero

[11] Patent Number: 5,415,574

[45] Date of Patent: May 16, 1995

[54] LAND VEHICLE FLOATABLE AND STEERABLE IN WATER

[76] Inventor: Roberto Siviero, via Trivulzio, 49-27029 Vigevano (Pv.), Italy

[21] Appl. No.: 149,071

[22] Filed: Nov. 9, 1993

[30] Foreign Application Priority Data

Nov. 11, 1992 [IT] Italy ..... MI92A2586

[51] Int. Cl.[6] ..... B63H 21/175

[52] U.S. Cl. ..... 440/12; 440/29

[58] Field of Search ..... 440/6, 11, 12, 21, 26-31; 114/270, 61

[56] References Cited

U.S. PATENT DOCUMENTS

| | | | |
|---|---|---|---|
| 547,422 | 10/1895 | Dean | 440/12 |
| 799,667 | 9/1905 | Payette | 114/270 |
| 1,646,664 | 10/1927 | Sanni | 114/270 |
| 2,757,631 | 8/1956 | Truter | 114/270 |
| 3,272,173 | 9/1966 | Avellino | 440/29 |
| 3,640,239 | 2/1972 | Petroskey | 440/12 |
| 3,844,246 | 10/1974 | Locher | 114/270 |
| 3,968,532 | 7/1976 | Bailey | 114/61 X |
| 4,287,845 | 9/1981 | Sanner | 114/61 X |
| 4,559,892 | 12/1985 | Cascallana | 440/30 X |
| 4,789,365 | 12/1988 | Jones | 440/21 |
| 5,226,843 | 7/1993 | Yun | 440/11 |

*Primary Examiner*—Sherman Basinger
*Attorney, Agent, or Firm*—Bucknam and Archer

[57] ABSTRACT

Land vehicle floatable and steerable in water, having inflatable sectors applied to the front and back frame with articulated tie-rods and supports. The rear wheel of the vehicle is adapted to strike a roller or an equivalent gear connected to a transmission gear provided with at least a shaft equipped with a propeller. The transmission gear is connected to the inflatable sectors by interposition of extension tubes, tie-rods or rigid supports.

4 Claims, 7 Drawing Sheets

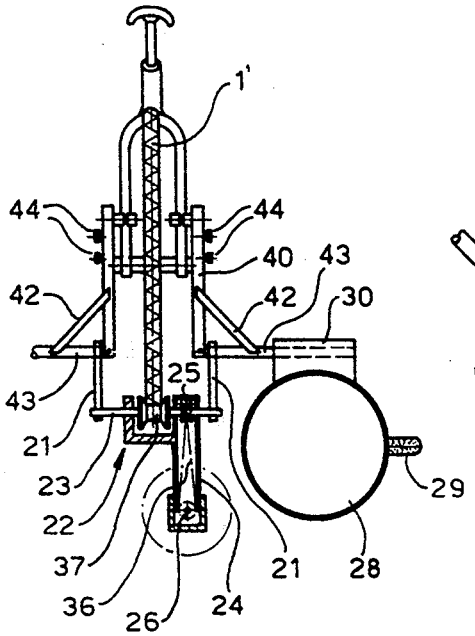
Fig.13
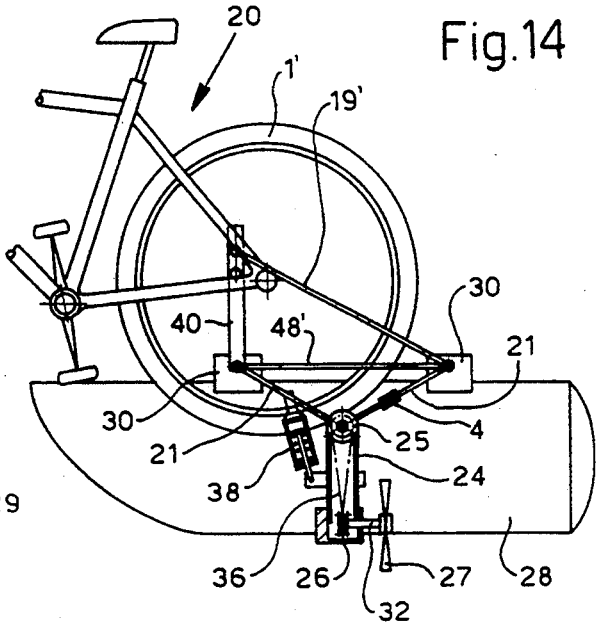
Fig.14
Fig.15
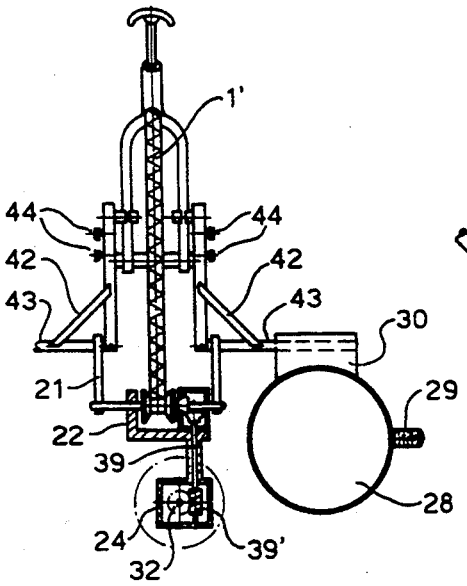
Fig.16
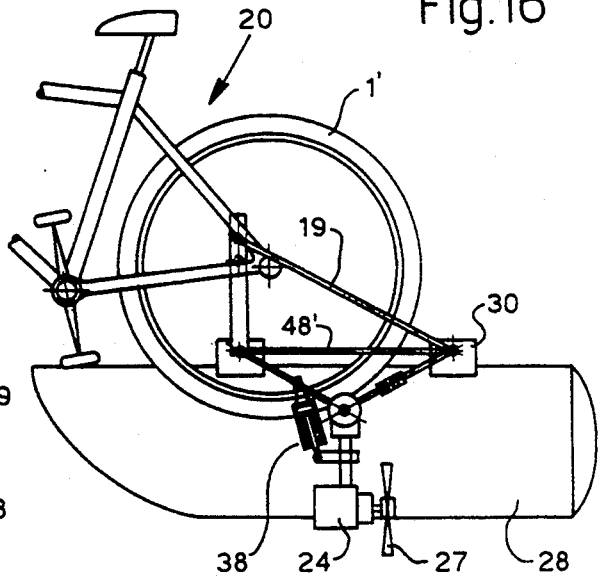

Fig.17
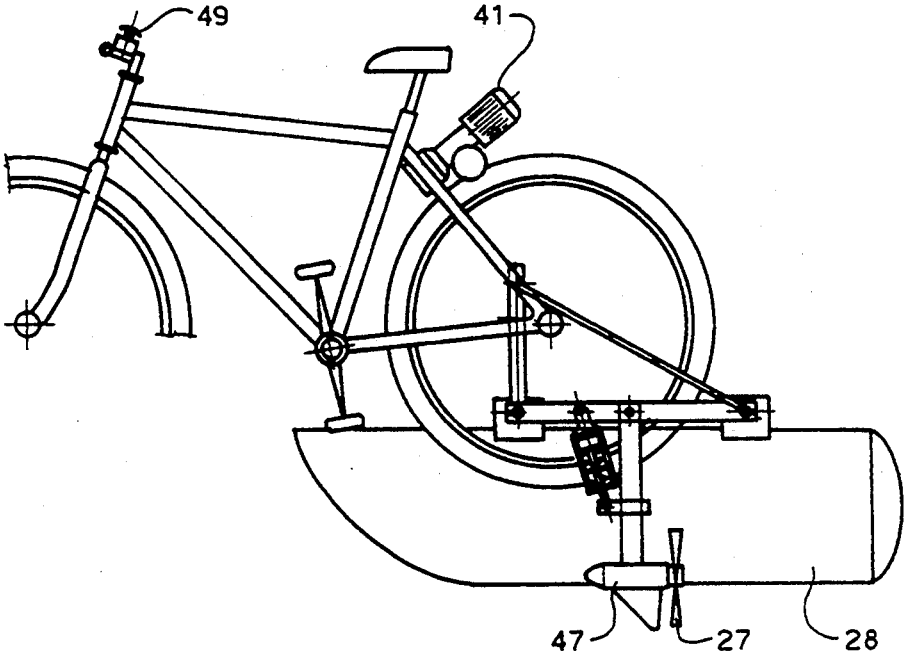
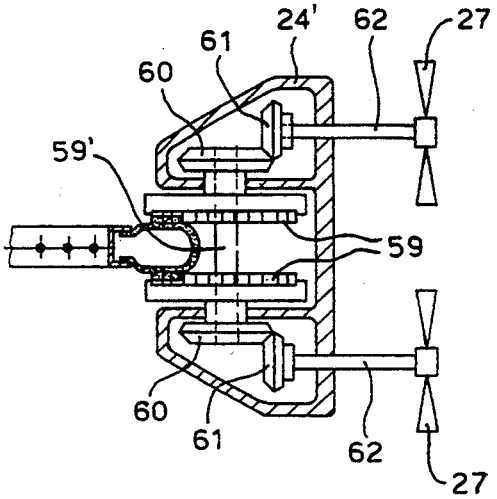
Fig.18
Fig.19
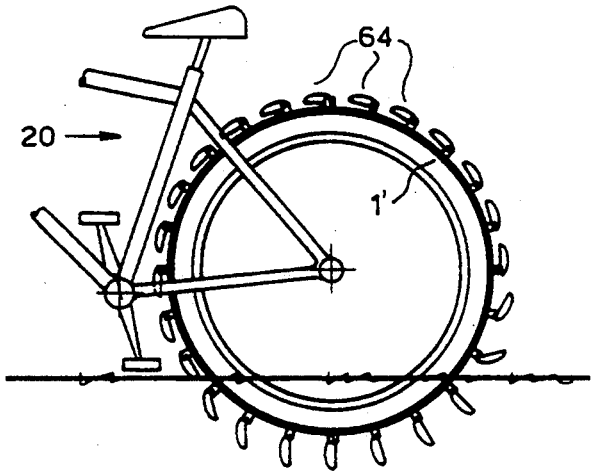

LAND VEHICLE FLOATABLE AND STEERABLE IN WATER

BACKGROUND OF THE INVENTION

The present invention relates to a land vehicle floatable and steerable in water.

More particularly, the present invention relates to a land vehicle floatable and steerable in water, having transportable equipment, easily assembled and disassembled, and utilizable, if required, to transform a traditional land vehicle into a vehicle capable of moving even in water.

The words "land vehicle" as used herein and in the claims, is meant any transport means having two or more wheels, such as a bicycle, a motorcycle, etc. Among these vehicles, the bicycle, and in particular the mountain-bike bicycle, is the preferred means.

The present description shall be limited, by way of example to a bicycle, even though the same results and advantages are obtained with other land vehicles.

The bicycle, especially in recent years, has undergone significant improvements and developments, which have led to new use proposals, both for sport and leisure purposes.

Technological sophistication has resulted in lighter, more reliable and comfortable bicycles, while the need of stimulating sporting activities or new proposals for free time has led to the proliferation of particular types of bicycles, used for instance on cyclo-tourist and cyclo-alpine courses, either on flat ground or in the mountains.

SUMMARY OF THE INVENTION

The present invention, whose primary object is to provide a bicycle having an innovative use is to be understood to be within this general trend of widening the field of use of the bicycle. In particular, an object of the present invention is to transform a bicycle, possibly of the mountain-bike type, into a floating vehicle, steerable in water.

Another object of the present invention is to provide mobile equipment, easily and rapidly applied to the bicycle and easily assembled and disassembled whenever it is not in use, suitable to transform a bicycle into a floating vehicle steerable in water, without structural or substantial modifications of the structure of the bicycle.

Still another object of the present invention is to provide mobile equipment of the above mentioned type, economically obtainable and such as not to require the use of complex technologies in production.

According to the present invention, these and other objects are obtained by a bicycle floatable and steerable in water having two coupled inflatable sectors positioned in association with the rear wheel; at least another inflatable sector placed beneath the front wheel; means for anchoring said sectors to the frame of the bicycle; and at least a group for the transmission of the rotatory motion of the rear wheel to the propelling gear. The construction and functional characteristics of the bicycle which is the subject of the present invention shall appear more clearly from the following description, wherein reference is made to the attached drawings which illustrate a preferred embodiment, as well as some execution variants of said bicycle, and wherein:

DESCRIPTION OF THE DRAWING

FIGS. 13 and 14 are schematic front and side elevational views of the bicycle according to another embodiment;

FIGS. 15 and 16 are the front and side schematic views of the portion of the bicycle according to yet another embodiment.

FIG. 17 is a schematic side elevational view of the rear sector of the bicycle according to yet another embodiment.

FIG. 18 is a schematic plan view, partly in cross section, of an execution variant of the transmission box;

FIG. 19 is a schematic side elevational view of the rear wheel of a bicycle provided with an execution variant of the gears for water steering;

DETAILED DESCRIPTION OF THE INVENTION

Figure 1:
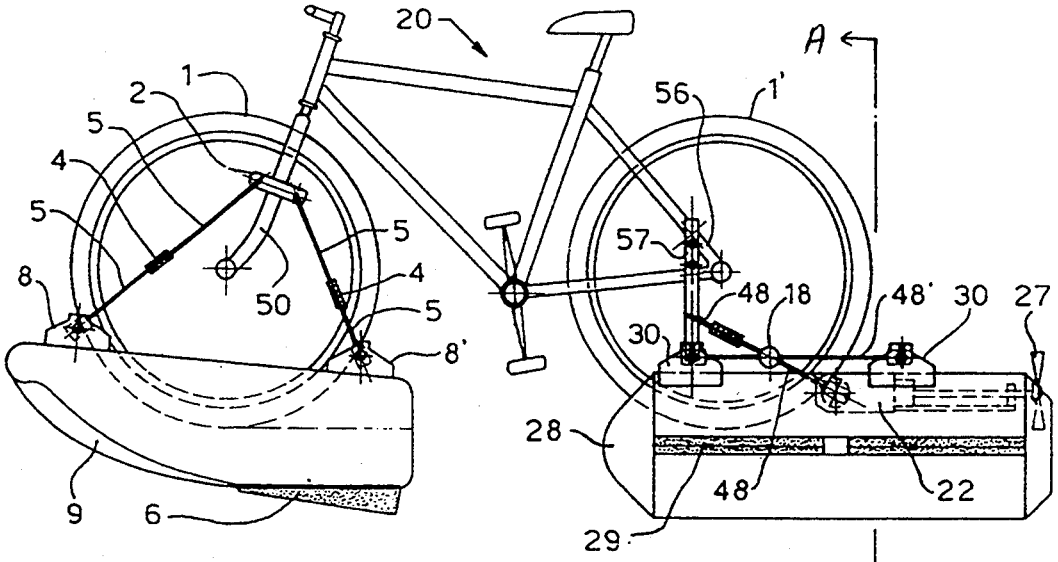
FIG. 1 is a schematic side elevational view of the bicycle provided with floating sectors according to the present invention.
Figure 3:
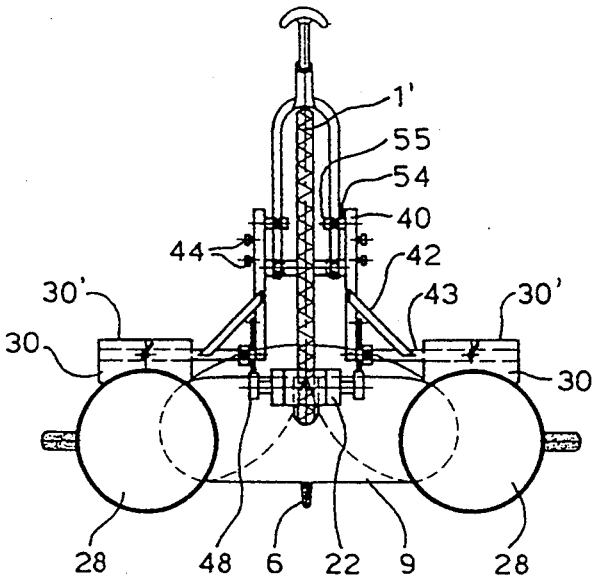
FIG. 3 is a schematic view of the bicycle taken along line A—A of FIG. 1.
Figure 2:
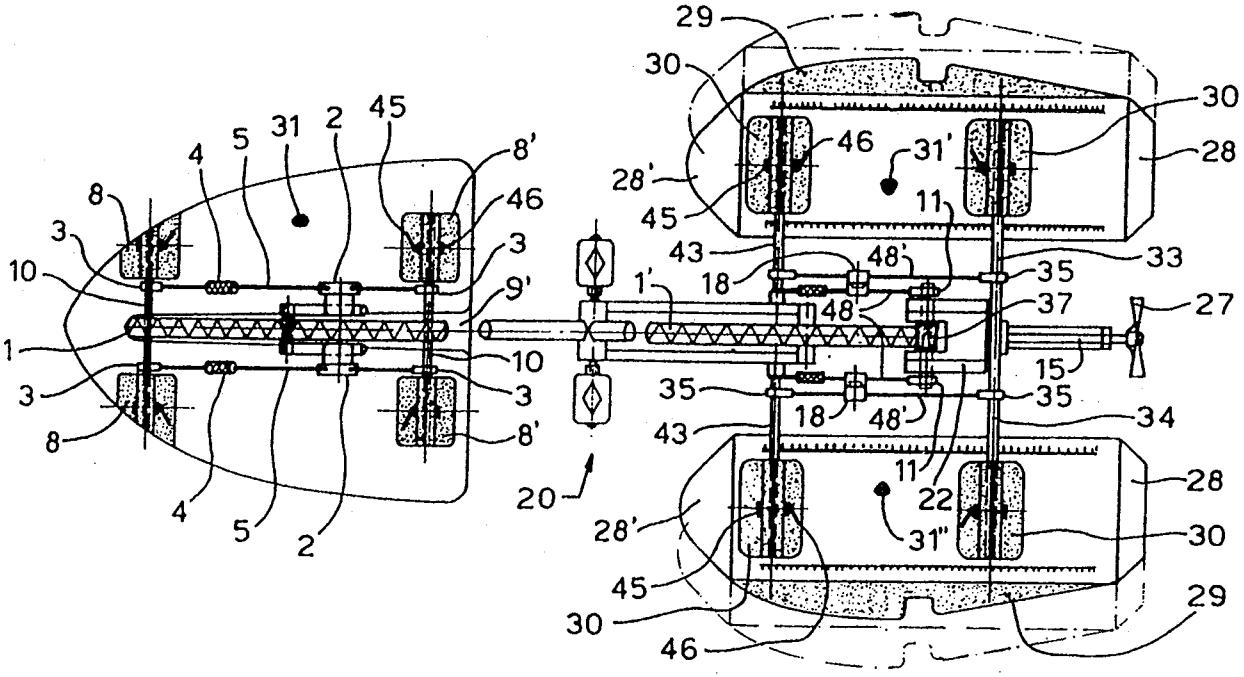
FIG. 2 is a schematic plan view, partly in cross section, of the bicycle according to the present invention.
Figure 4:
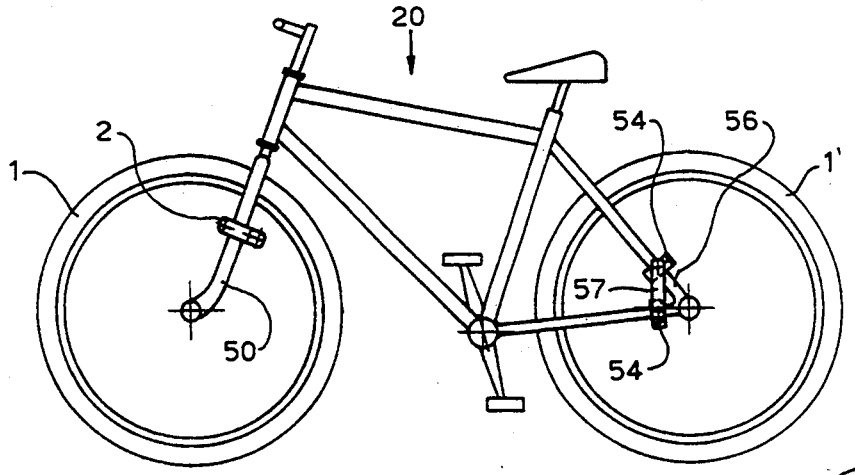
FIG. 4 is a schematic side elevational view of the bicycle equipped only with the connection members.
Figure 5:
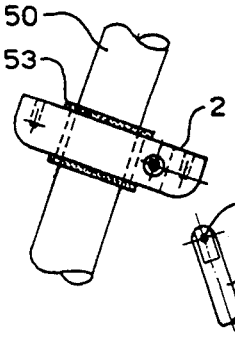
FIG. 5 is a schematic side elevational view of the clamp applied to the front fork of the bicycle.
Figure 7:
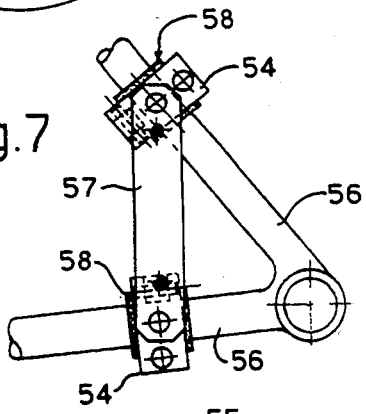
FIG. 7 is a schematic side elevational view of one of the fixed supports applied to a front of the rear fork of the bicycle, with the associated end clamps.
Figure 6:
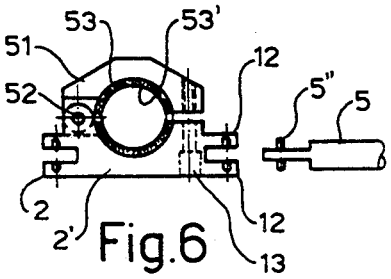
FIG. 6 is a schematic plan view of the clamp of FIG. 5.

Turning first to FIGS. 1 through 3, the water steerable floating bicycle (20) of the present invention comprises: two coupled inflatable sectors (28), positioned in association with rear wheel (1'); a further inflatable sector (9), placed beneath front wheel (1); means for anchoring said inflatable sectors (28, 9) to the bicycle frame, and a group (22) for the transmission of the rotatory motion of back wheel (1') to the propelling gear, which in FIGS. 1 through 18 consists of a propeller (27). The front (9) and rear (28) inflatable sectors consist of small rafts made of thermoplastic and possibly reinforced material, which can be inflated with air through associated and traditional valves (31). According to a preferred embodiment, the front inflatable sector (9) has the shape of a pointed hull, having a basically triangular or cylindric cross-section and whose height decreases progressively towards the front of the bicycle (20). The upper surface of sector (9) is flattened and provided with a lower seat (9'), which develops along the horizontal axis. Said seat (9'), which has a limited width, has a variable depth, which decreases progressively as it comes closer to the end front portion of said inflatable sector (9). On the whole, seat (9'), along said advanced portion, is cradle-shaped and has a concavity which corresponds to a part of the front wheel (1) of bicycle (20). The lower surface of sector (9) is preferably provided with a steering fin (6).

The upper surface of sector (9) is provided with protruding blocks (8, 8') coupled two by two, made of rigid foamed plastic material or the like, adapted to be integral with said sector (9), for instance by glueing. Each couple of blocks (8, 8') is fixed onto the upper surface of the inflatable sector (9), laterally to the lower seat (9') associated with each end of said seat (9'). Blocks (8, 8') are provided with a through-hole, orthogonal to the seat (9'), formed at about half-height of the same. The opposite heads of a tube (10) are pressure-housed in the through-holes of said blocks. Each tube (10) is the anchoring means of an end of a couple of tie-rods (5), which, at the opposite end, are connected to a flexible support integral with the frame of bicycle (20), as specified hereafter. Said tie-rods (5), made of aluminium or its alloys or other suitable material, are constituted by two lengths connected to one another by means of a stretcher. The stretcher may be a sleeve having holes with opposed thread or rapid clutches on the heads; the ends of the length of each of tie-rods (5) are threaded and clutch and screw in said sleeve which is the stretching member of same.

The lower end of tie-rods (5), associated with the inflatable sector (9) is caused to be integral by means of a generic collar (3) or other equivalent system, with tubes (10), clutched into blocks (8, 8'). The top opposite end of tie-rods (5) is connected to a clamp (2), fixed in its turn to the front fork (50) of the bicycle. With special reference to FIG. 6, clamp (2) comprises a base (2'), on a side of which a cap (51) is hinged by means of a generic pin (52). Said base (2') and said cap (51) are secured to each other, on the opposite side, by a screw (13) which clutches into corresponding holes provided on same, and they define a round seat (53) whose diameter is basically equal to the diameter of the branches of the front fork (50) of bicycle (20). Along seat (53) an insulating material covering (53') is advantageously provided, constituted preferably by a plurality of concentric sectors, removable for adaptation to any diameter. Said insulating material comes directly in touch with the branch of said fork (50) when clamp (2) is tightened on same.

Base (2') of clamp (2) is provided, on each of the respective ends, with two drilled extensions (12), slightly distant from one another. Said extensions (12) define a U-shaped seat wherein the upper end of tie-rods (5), provided also with a hole, abuts. The connection between said ends of tie-rods (5) and clamp (2) is obtained by means of generic screws or equivalent fastening means.

A preferred embodiment provides for the formation of concave non-through seats on the upper surface of each protruding branch (12) wherein a pin (5'') is rapidly housed, which is fixed and protrudes from the opposite ends of tie-rod (5). Another preferred embodiment provides for a clamp (2), as described above, being placed on each of the branches of the front fork (50) of bicycle (20), so as to connect the inflatable sector (9) to each of said branches by means of a couple of tie-rods (5).

It is advantageously possible to preliminarily place clamps (2) on each branch of fork (5) and keep the same mounted even if bicycle (20) is used in the traditional way; clamps (2), in fact, do not alter the structure and the possibilities of the vehicle, while causing the application of the inflatable sector (9) to be particularly rapid and easy in case of need.

To make the operation of placing tubes (10) in blocks (8, 8') easier, the latter are preferably provided with a longitudinal milling, which develops starting from the exposed upper surface and ends into the circular seat wherein the end of tube (10) is housed. The portions of the blocks separated from each other by the milling are then tightened by means of screws with nuts or the like, clutched and going into corresponding holes provided in the block portions.

The rear inflatable sectors (28) consist of small rafts, inflatable with air by means of valves (31', 31'') respectively. Said sectors are made of the same material as the one which forms the front sector (9) and have a preferably round cross-section which corresponds to a cyclindrical structure. The two inflatable rear sectors (28) are coupled in association with the rear wheel (1') of bicycle (20). The fore front (28') with respect to the running direction of the bicycle, has preferably a tapered shape, to obtain the best hydrodynamic adaptation. On the side looking towards the outside of each sector (28) a protection rib (29) is provided, extended longitudinally, autonomously inflatable or constituted by rigid added plastic material. The upper surface of each of the inflatable rear sectors (28) is provided with a pair of protruding blocks (30), similar to blocks (8) of the front inflatable sector (9), aligned with one another and having a base so shaped as to be caused to mate and to be integral with said inflatable sectors by means of a possible interposition of a connection plate (7) of plastic material, which adjusts to the convex surface of each sector and constitutes a reinforcement base for the blocks. The base of said blocks is orientated towards the inflatable sectors and is so shaped as to adhere to the surface of the latter, while the upper surface (30') is orientated upwards, parallel with the protruding rib (29). Blocks (30) are provided with a longitudinal milling (14) which develops starting from said upper surface for a height equal to about half the height of the blocks, and ends in a round section seat. Said round section seat houses the horizontal arms (43) of opposite articulated supports. Said supports are the members that stably connect sectors (28) to the opposite branches (56), which form the rear fork of bicycle (20), as described hereafter.

Figure 9:
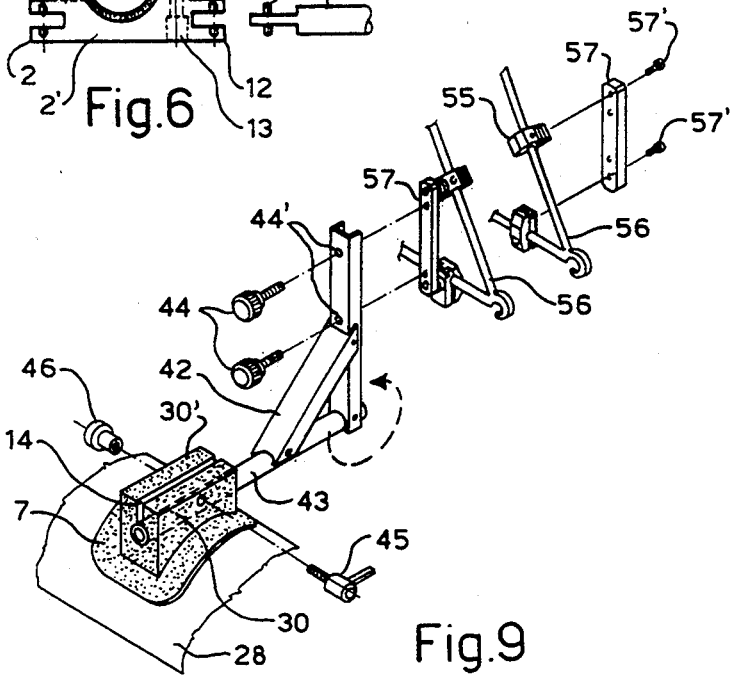
FIG. 9 is an exploded schematic view of the connection members of one of the floating sectors of the bicycle of FIG. 1.
Figure 10:
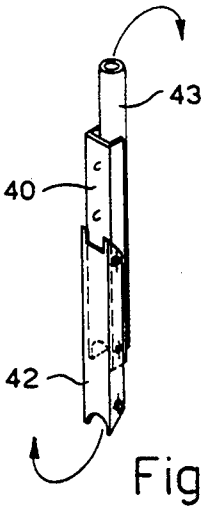
FIG. 10 is a perspective schematic view in closed position of the articulated support of the connection elements of FIG. 9.

Each of the articulated supports is composed of three elements, pivoted to one another, constituted by said tube-shaped horizontal arm (43), a section (40) suitable to be placed perpendicularly to said arm (43) and a crosspiece (42) which connects and keep in orthogonal opposition, during the utilization stage, said arm (43) and section (40), as illustrated on FIG. 9.

The free end of arm (43) of each articulated support clutches into the round section seat of blocks (30), connected to sector (28) near the tapered fore front (28'). The fastening of arm (43) to the relative block (30) is ensured by opposite threaded bushes (46) and screws (45), which by clutching into corresponding holes provided in blocks (30) in correspondence of the milling, realize a jaw-tightening. Each of sections (40), which develop upwards perpendicularly with respect to arm (43) has advantageously a U-shaped section, with the cavity orientated towards each of the branches (56) of the rear fork of bicycle (20). Branches (56) are provided with a support (57), constituted by a small bar, placed vertically, having a quadrangular section and a width such as to clutch into the cavity of the U-section (40). Bars (57) are caused to be integral with both branches (56) of the rear fork by means of two clamps constituted by a base (54) and a cap (55), as illustrated in FIG. 8, basically analogous to clamps (2) placed on the front fork (50) of bicycle (20).

Figure 8:
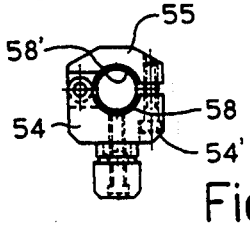
FIG. 8 is a schematic plan view of one of the support clamps of FIG. 7.

Base (54) and cap (55) of each of said clamps, illustrated in detail in FIG. 8, define centrally a round seat (58), covered by insulating material (58'), within which a branch (56) of the back fork is tightened by means of a generic screw (54'). Each of bars (57) is provided with holes (57') suitable to align with holes (44') provided on the U-shaped section (40). Screws (44), having a knob or quick-clutch handle, permit to fasten said sections (40) and said bar (57), realizing the connection between branches (56) of the rear fork of bicycle (20) and the articulated supports whose arm (43) is integral with the inflatable sectors (28) through the front couple of blocks (30). Supports (57) with the associated fastening clamps (54, 55), analogously to clamps (2), integral with the branches of the front fork (50), may be preliminarily placed on branches (56) of the rear fork of bicycle (20) and kept there, as they do not prevent use of the vehicle in the traditional way. Each inflatable sector (28) is provided with still another couple of blocks (30), whose structure is identical to that of the above described blocks, and which are aligned with same and placed near the back end of said sector.

An extension tube, composed of two elements (33) and (34), sliding into one another, is placed in the round seat provided in said blocks and connects therefore directly to one another the two inflatable rear sectors (28), along an axis placed at the rear of wheel (1') of bicycle (20). The length of said tube, made of aluminium, its alloys or any suitable material, is such as to align the rear sectors (28) along axes parallel to the longitudinal axis of the front sector (9). A couple of tie-rods (48') connects to each other, by means of traditional collars (35) or equivalent means, elements (33) and (34) of the extension tube, with the horizontal arms (43) extending from the front blocks. Along said tie-rods (48'), articulated joints (18) are provided, constituted, for instance, by a couple of small cylinders placed near one another, connected to one another and sliding on one another.

The cylinders that form the articulated joint (18) are provided with a hole for the clutching and connection, with known means, of the ends of tie-rods (48') with still another couple of tie-rods (48), analogous to the preceding ones and placed parallel to same.

Tie-rods (48) are connected with their front end orientated towards the running direction of the bicycle to the horizontal arms (43); and with the opposite end they are connected for instance by means of pins (11), to transmission gears (22). Said transmission gears comprise a shaft (23) on which a roller basically cylindrical (37) and suitably grooved is keyed. Said roller (37) is bound to come to touch the back wheel (1') of the bicycle.

Figure 11:
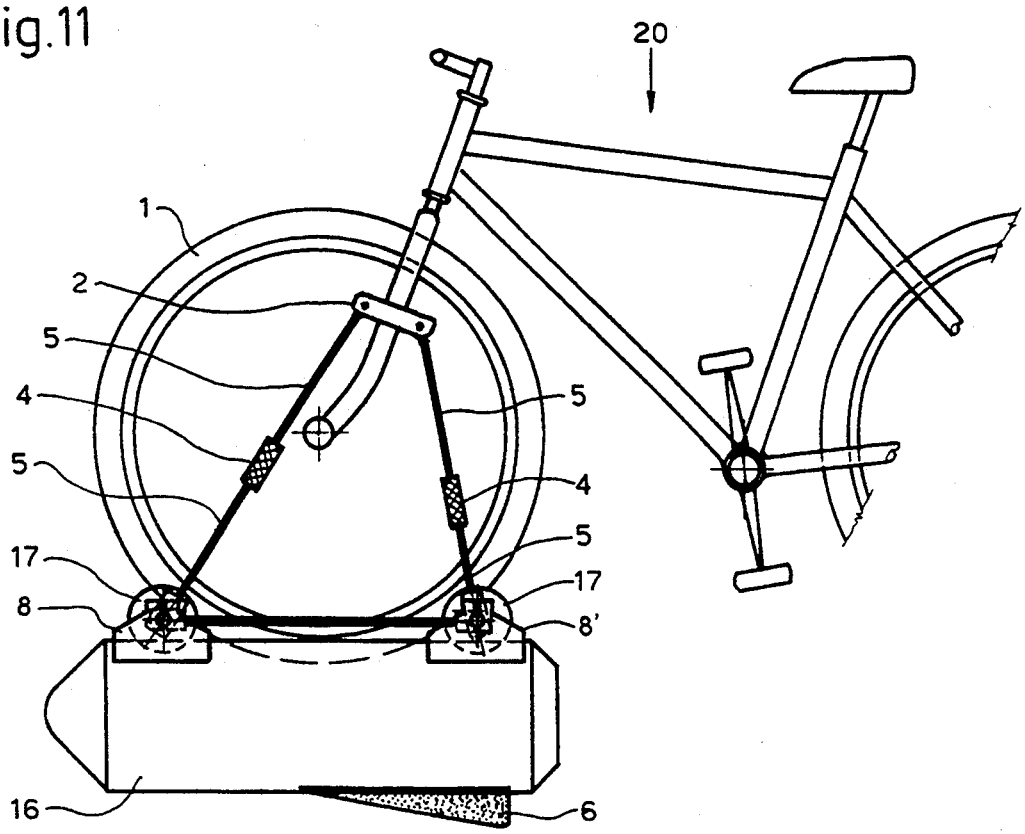
FIGS. 11 and 12 are perpsective views in closed position of the articulated support of the connection elements of the bicycle.
Figure 12:
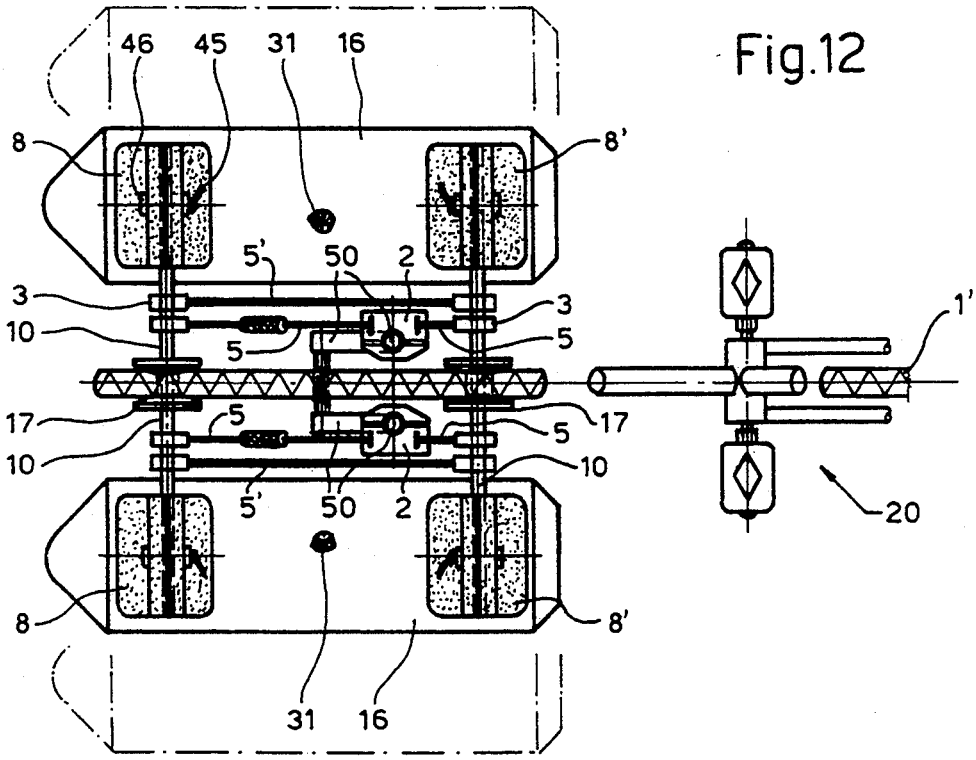

The transmission gears (22) comprise conical gears or the like (not shown in detail, being of a known type), which, when wheel (1') is moving cause a shaft (15), parallel to wheel (1') and the longitudinal axes of the inflatable sectors (28), to rotate. The free end of said shaft (15), placed along the longitudinal axis of bicycle (20) between the inflatable sectors (28) is provided with a propeller (27), which is the propelling element. FIGS. 11 and 12 refer to another embodiment of the front inflatable sector (16); in this embodiment, the front wheel of bicycle (20) is connected to two coupled inflatable sectors (16), provided with front (8) and back (8') blocks, analogous to those of sector (9). Two tubes (10) are inserted and fixed to said blocks (8, 8'), and two tie-rods (5') are connected to them by means of collars (3)

Said tie-rods (5') are placed parallel with respect to sectors (16). Still another couple of tie-rods (5) is connected in the same way to tubes (10) and connects said tubes (10) to clamp (2), integral with the front fork (50) of bicycle (20). Tie-rods (5) are preferably provided with stretchers (4) identical to those of the stretchers shown in FIG. 1. In correspondence of the central sector, each of tubes (10) is provided with two supports (17) placed near to one another, of any shape whatever, suitable to define a side restraint seat for the front wheel (1). With reference to FIGS. 13 and 14, a preferred embodiment of the transmission gears (22) and of the associated means for connecting them to the rear inflatable sectors (28) is described. Each of said inflatable sectors, proposed, by way of example, with a markedly arched front end, is provided with the front and back protruding blocks (30), aligned with one another and connected by a tie-rod (48'). The end of a second tie-rod (19'), which, at the opposite end, is connected to section (40) of the above mentioned articulated support, is fixed to the back block (30). Two tie-rods (21), provided with stretcher (4), are articulated to the horizontal arms (43) of said support. The end of said tie-rods (21) is provided with holes for housing a shaft (23), on which roller (37), driven by the back wheel (1') of bicycle (20), is keyed in a basically central position. Shaft (23) is connected to a transmission box (24) and causes the rotation of a gear or gearwheel (25) housed within and keyed on said shaft. In opposite position with respect to said gear (25) and rotated of 90° as to same, a gearwheel (26) is housed in said box; said gearwheel is keyed on a shaft (32), which protrudes beyond box (24) and carries at the end propeller (27). A toothed belt (36), fitted on gearwheels (25, 26), causes shaft (32) and consequently propeller (27) to rotate, as a consequence of the moving of roller (37) through the back wheel (1') of bicycle (20).

Between the transmission box (24) and tie-rods (21) connected to arms (43), a damper (38) is preferably and articulatably placed, suitable to permit, if need be, the oscillation of said box. Two transmission boxes (24), coupled to one another, are obviously to be provided, should one wish to realize a propelling group constituted by two propellers (27).

FIGS. 15 and 16 refer to still another embodiment which basically takes on the construction characteristics of the preceding one as concerns the position and connection of the transmission box (24). In this embodiment, belt (36) is replaced by a shaft (39) whose end carries a worm screw (39') which engages shaft (32) and acts as a reduction gear as to the rotation of same and consequently of propeller (27). FIG. 17 shows schematically still another embodiment of the transmission group, which in this case adopts a low-voltage d.c. generator (41) applied to bicycle (20), and a motor (47), connected to said generator, which causes propeller (27) to rotate.

In this embodiment, bicycle (20) is preferably equipped with a control device (49), which permits to operate the reversal of the connections of the electric circuit; it ensues from this that, by reversing polarity, propeller (27) rotates in the opposite direction with respect to that that ensures the running, realizing, as a consequence, a braking action of the bicycle. FIG. 18 shows schematically still another embodiment of the transmission box, indicated by reference number (24'). Through a roller (37), such as the above mentioned one, or by means of opposing plates (59') between which the side of the tire of the rear wheel (1') of bicycle (20) abuts, a shaft (59') is caused to rotate, which carries at the opposite ends a conical gear (60). Each of said gears (60) causes another conical gear (61) to rotate, which is placed at 90° with respect to the first one (60). A shaft (62), carrying at its end the usual propeller (27), is keyed on this further gear.

FIG. 19 shows schematically an embodiment concerning the transmission of the motion in water through the rear wheel (1') of bicycle (20). A covering (63) is placed on the tire of said wheel, said covering being possibly extended to the side bands, provided along its perimetry with flexible paddles (64), originally aligned with same covering. Said paddles (64) may be obtained directly with the covering, preferably made of flexible plastic material, or added and fastened, by means of pins or the like, to blocks protruding from it. Paddles (64) are orientated in such a way as to extend until they come in touch with water, assuming therefore an orientation which is basically perpendicular with respect to the standstill position, realizing therefore in this stage as many thrust points.

The back and/or front inflatable sectors may also be placed as side extensions, as shown by way of example and in the hatched part in FIGS. 3 and 12. The arrangement which sectors (16, 28) can assume depends on the position and blocking of tubes (10, 33, 35) in the associated seats provided in blocks (8, 8', 30). In the following are shortly described the application of the equipment to the bicycle and the running of the so assembled whole, even though they can be easily inferred from the above explanation.

The front (9,16) and back (28) inflatable sectors, filled with air, are placed in association with the front (1) and rear (1') wheel of the bicycle and rapidly connected, through tie-rods (5, 5', 48, 48') and the articulated supports, to clamps (2, 57), already caused to be integral with the corresponding front (50) and rear (56) forks of said bicycle.

The rotation of the rear wheel (1') drives roller (37) (and possibly plates 59), in touch with it and, through the gears placed in the transmission box, shaft (15, 59') carrying propeller (27) which thrusts forwards the vehicle. In the alternative embodiment of FIG. 19, said thrust is ensured by paddles (64) obtained along covering (63), which is placed on the back wheel of the bicycle.

As front tie-rods (5) are connected with the fork of the bicycle, the steerage of the whole is ensured, as the latter can be orientated towards the rightside or the linkside by means of the handle bar.

As can be inferred from the above, the manifold advantages of this invention are evident.

Said means can be easily assembled to or disassembled from the bicycle and can be therefore easily transported and mounted only when required.

However, the invention, according to the above description and the claims specified hereafter, has been proposed only by way of example, being understood that the same is susceptible of many modifications and variants, all of them falling within the scope of the inventive concept.

For instance, the transmission box might be provided with a selector, operatable by means of a tie-rod or the like, suitable to realize the reversal of the rotation direction of the shaft carrying the propeller. The inflatable sectors may be connected to each other and/or the bicycle by means of still other tie-rods placed transversally with respect to stabilizing bars. In addition, said sectors may be replaced by a single raft, suitably shaped and inflatable to support the bicycle or possibly a motor-velocipede.

While the inflatable sectors can be easily utilized, and are therefore preferred, they may be replaced by rigid sectors, made of one only piece or foldable, of plastic material, resin-glass, wood or the like, if there are no critical requirements of limiting volumes.

Figure 20:
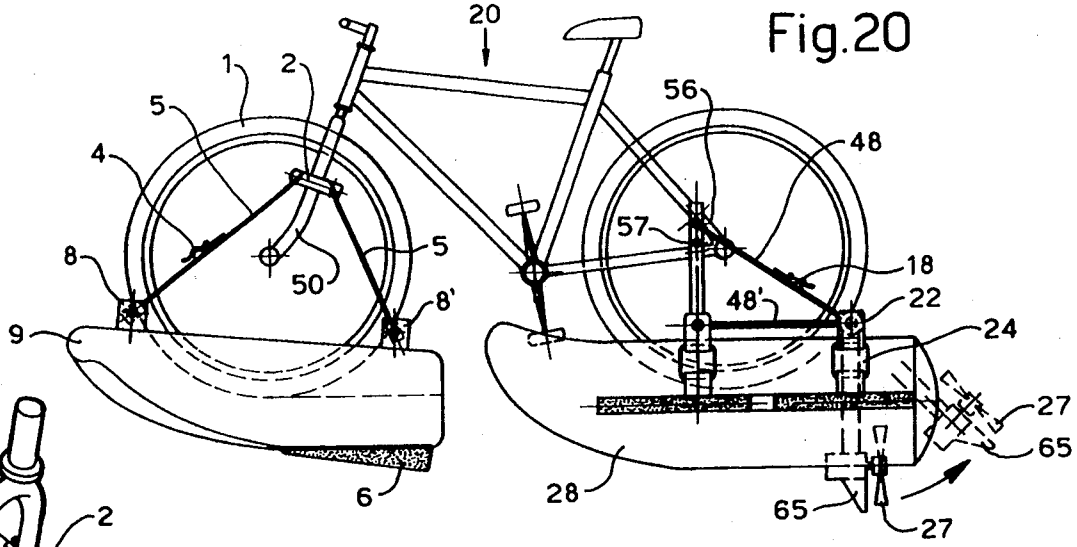
FIG. 20 is a schematic side elevational view of the bicycle of the preceding figures with the articulated transmission-propulsion group.
Figure 23:
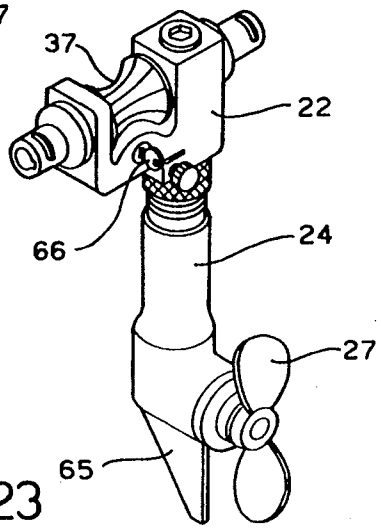
FIG. 23 is a schematic perspective view of the transmission-propulsion group provided with a system of safety blocking.

The transmission box (24) with the associated propulsion means (27) may be articulatably mounted (see FIG. 20): in this way it can automatically shift from the basically vertical running position to a position intermediate between the vertical and the horizontal one, following rubbing due to shoals or different obstacles.

A removable fin (65), placed at the lower end of the propelling group and higher than a propeller blade, protects said propeller from shoals and/or obstacles, acting at the same time as a steering member.

Figure 22:
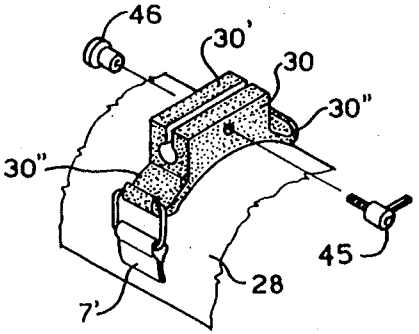
FIG. 22 is a schematic perpsective view of a variant of the protruding blocks fastened to the inflatable sector by means of a ring fixed to said inflatable sector.
Figure 21:
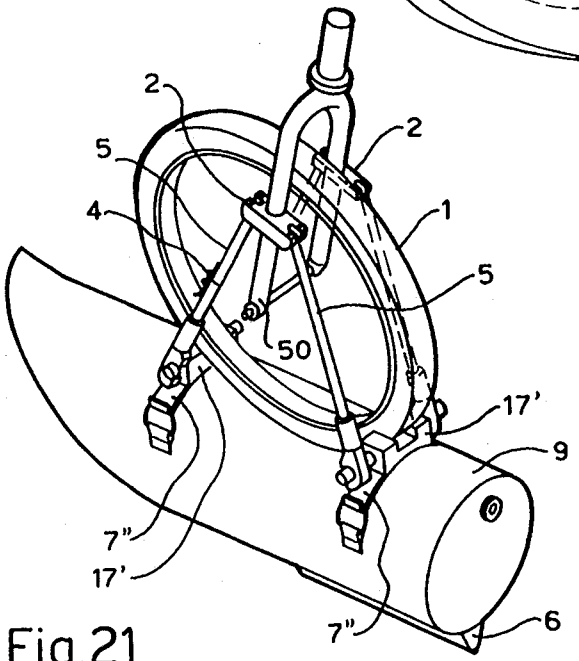
FIG. 21 is a schematic perspective view of the front part of the bicycle with the tie-rod supports connected to the inflatable sector by means of belts.

According to still another embodiment, shown in FIG. 22, the fastening of the protruding blocks (30) to the associated floating sectors (28) may be obtained by providing said block (30) with an extension bent upwards (30") on both ends and hooking to said bent extensions (30") a ring fastened to the inflatable support (28) by means of a flexible belt (7'). Still another embodiment concerns the front inflatable support (9) shown in FIG. 21. Said embodiment is equipped with a couple of bearing and trueing means (17') for the front wheel (1), placed along the longitudinal axis of the inflatable support (9), connected to the latter by means of flexible belts (7") fastened to said support.

I claim:

1. A land vehicle adaptable to be floatable and steerable in water, comprising:

A) a land vehicle having a frame, at least one front wheel supported on a frame member connected to said frame for steering said vehicle on land, at at least one rear wheel supported on said frame and adapted for propelling said vehicle on land, and B) a floatation system for said land vehicle disassemblable for compactness and ease of carrying, said floatation system including, a) a front inflatable sector associated with said at least one front wheel and having a lower seat therein along the horizontal axis of said sector, said lower seat having a limited width and terminating at its forward end in a cradle-like shape corresponding to a part of said at least one front wheel, said sector also including a steering fin provided on the lower surface thereof, b) a pair of coupled rear inflatable sectors associated with said at least one rear wheel laterally arranged with respect thereto, c) means for connecting said front inflatable sector to said frame member supporting said front wheel including a clamp arranged on each lateral side of said frame member connected to said front sector fore and aft by tie-rods each having a stretcher therein, said clamp having front and rear U-shaped extensions within which the upper rods of said tie-rods are pivotally connected to said clamp, d) means for connecting said rear inflatable sectors to said frame supporting said rear wheel, comprising a pair of laterally aligned front blocks on said sectors arranged laterally with respect to said at least one rear wheel, each block having a cross-milling forming a seat for housing and clamping a horizontal arm of an articulated support which further includes a section arranged perpendicular to said arm and a crosspiece which maintains the orthogonal position of said arm and said section during use of said floatation system, said section being connectable to a support attached to said frame, and a further pair of laterally aligned rear blocks on said sectors aligned with said front blocks and positioned to the rear of said at least one rear wheel and having the same structure as said front blocks, a telescoping extension tube extending between the rear blocks and housed and clamped in the seats formed therein, a tie-rod interconnects each horizontal arm of the front articulated supports with said telescoping extension tube, each said tie-rod includes an articulated point therealong through which passes a further parallel tie-rod connected at the front to the corresponding horizontal arm of the articulated support and at the rear to a transmission gear which transmits the driving movement-of the at least one rear wheel to a propeller for driving the vehicle in water.

2. The land vehicle according to claim 1, wherein the front and rear inflatable sectors consist of small rafts of reinforced thermoplastic material, and the front inflatable sector has a pointed hull-shape, with a substantially triangular section, a height progressively decreasing towards the fore front of the vehicle, and the back inflatable sectors have a round section, a tapered fore front and are provided with a side protection rib.

3. The land vehicle according to claim 1, wherein the tie-rods placed parallel with respect to the tie-rods interconnecting the horizontal arms of the front articulated supports with the telescoping extention tube, whose front end is connected to the horizontal arm and at the rear thereof to a transmission gear, wherein the transmission gear includes a shaft on which a roller is keyed which strikes the at least one rear wheel of the vehicle.

4. The land vehicle according to claim 1, wherein the land vehicle consists of a bicycle.

* * * * *